US009622568B1

(12) United States Patent
Lin

(10) Patent No.: US 9,622,568 B1
(45) Date of Patent: Apr. 18, 2017

(54) TABLE WITH EXTENDABLE TOP

(71) Applicant: Zhuhai Shichang Metals Ltd., Zhuhai (CN)

(72) Inventor: Wen-Sheng Lin, Kaohsiung (TW)

(73) Assignee: Zhuhai Shichang Metals Ltd. (CN)

( * ) Notice: Subject to any disclaimer, the term of this patent is extended or adjusted under 35 U.S.C. 154(b) by 0 days.

(21) Appl. No.: 15/045,358

(22) Filed: Feb. 17, 2016

Related U.S. Application Data

(63) Continuation-in-part of application No. 29/543,890, filed on Oct. 29, 2015, now Pat. No. Des. 770,205, and a continuation-in-part of application No. 29/543,891, filed on Oct. 29, 2015, now Pat. No. Des. 772,623.

(51) Int. Cl.

| | |
|---|---|
| ***A47B 1/02*** | (2006.01) |
| ***A47B 1/04*** | (2006.01) |
| ***A47B 1/10*** | (2006.01) |
| ***A47B 13/08*** | (2006.01) |
| ***A47B 3/091*** | (2006.01) |

(52) U.S. Cl.
CPC ..... *A47B 1/04* (2013.01); *A47B 1/10* (2013.01); *A47B 3/0912* (2013.01); *A47B 13/081* (2013.01); *A47B 13/088* (2013.01)

(58) Field of Classification Search
CPC .... A47B 1/02; A47B 1/08; A47B 1/10; A47B 1/04; A47B 3/0912; A47B 13/081; A47B 13/088; A47B 13/003
See application file for complete search history.

(56) References Cited

U.S. PATENT DOCUMENTS 3,294,042 A 12/1966 Charne et al.
3,336,883 A 8/1967 Wengi
4,553,485 A * 11/1985 Lee ..... A47B 1/03 108/86

(Continued)

FOREIGN PATENT DOCUMENTS

CN 2282358 Y 5/1998
CN 2297909 Y 11/1998

(Continued)

*Primary Examiner* — Hanh V Tran
(74) *Attorney, Agent, or Firm* — Luedeka Neely Group, PC

(57) ABSTRACT

An extendable table movable between an extended position and a retracted position is disclosed. The table includes a generally rectangular table frame, outer sliding tracks secured to the rails of the table frame, first and second cross members also secured to the rails of the table frame, as well as four table legs. The table includes first and second movable table tops, each having a molded plastic table top surface, and inner sliding tracks which are slidingly received within the outer sliding tracks so that the first and second table tops are movable between a retracted position and an extended position. The table includes a leaf, having a molded plastic table top surface and first and second retainers disposed on an underside of the table leaf. The table leaf is movable from a storage position, in which the table leaf rests on the cross members beneath the sliding table tops, and a use position, in which the table leaf retainers are fitted over and mated with portions of the first and second cross members so that the table leaf top surface is aligned between and substantially coplanar with the first and second sliding table tops.

11 Claims, 6 Drawing Sheets

(56) References Cited

U.S. PATENT DOCUMENTS

| | | | | |
|---|---|---|---|---|
| 4,794,869 | A * | 1/1989 | Chiu | A47B 1/02 108/86 |
| 5,461,989 | A | 10/1995 | Grandclement et al. | |
| 5,735,220 | A | 4/1998 | Wang | |
| 6,742,461 | B1 * | 6/2004 | Sen | A47B 1/02 108/86 |
| 7,975,625 | B2 | 7/2011 | Topham et al. | |
| 9,173,481 | B2 * | 11/2015 | Haansbæk et al. | A47B 1/05 |
| 2003/0192459 | A1 * | 10/2003 | Annas | A47B 1/08 108/86 |
| 2004/0050305 | A1 * | 3/2004 | Han | A47B 3/0912 108/83 |
| 2004/0173127 | A1 * | 9/2004 | Chiang | A47B 1/02 108/84 |
| 2005/0034639 | A1 * | 2/2005 | Li | A47B 1/02 108/83 |
| 2008/0264306 | A1 * | 10/2008 | Mullen | A47B 1/02 108/83 |
| 2013/0047898 | A1 * | 2/2013 | Lee | A47B 1/03 108/86 |

FOREIGN PATENT DOCUMENTS

| | | | |
|---|---|---|---|
| WO | 2004058003 | A2 | 7/2004 |
| WO | 2004058003 | A3 | 7/2004 |
| WO | 2004058004 | A2 | 7/2004 |

* cited by examiner

TABLE WITH EXTENDABLE TOP

CROSS-REFERENCE TO RELATED APPLICATIONS

This application is a continuation-in-part of co-pending design patent applications, 29/543,890 and 29/543,891, both filed Oct. 29, 2015. The disclosures of both applications are herein incorporated by reference.

FIELD

This disclosure relates to folding tables. More particularly, this disclosure relates to folding tables having movable table tops which may be extended to differing table top lengths.

BACKGROUND

It is often desirable to have a table whose table top may be extended or retracted to different overall table top lengths. In this way, a single table may suitably be used for a larger variety of tasks. This would be particularly advantageous for a table which is only used on an occasional basis and which is kept in storage at other times. However, the addition of extendable table top features adds considerable weight, complexity, and cost to a table which is undesirable. Accordingly, there is a need for a table whose table top may be extended or retracted to different overall table top lengths, which is still relatively simple, lightweight, and inexpensive.

SUMMARY OF THE INVENTION

The above and other needs are met by an extendable table according to the current disclosure. According to one embodiment, the extendable table includes a table frame, which in turn includes first and second longitudinal frame rails and third and fourth transverse frame rails secured to opposite ends of the first and second frame rails. The first and second frame rails are oriented generally parallel to one another, and the third and fourth frame rails are oriented generally parallel to one another and perpendicular to the first and second frame rails, so as to define a generally rectangular frame having four corners.

A first outer sliding track is secured adjacent an inner surface of the first longitudinal frame rail and a second outer sliding track is secured adjacent an inner surface of the second longitudinal frame rail.

The table also includes first and second cross members each having a first end and a second end. The first ends of each cross member are secured to a lower portion of the first longitudinal frame rail, and the second ends of each cross member are secured to a lower portion of the second longitudinal frame rail.

In addition, the table includes first, second, third, and fourth table legs, with each leg being secured to a different corner of the table frame.

First and second movable table tops are also included in the table, with each of the table tops including a molded plastic table top surface, a first inner sliding track secured adjacent a first outer edge of the table top, and a second inner sliding track secured adjacent a second outer edge of the table top. The inner sliding tracks of the first and second table tops are slidingly received within the outer sliding tracks so that the first and second table tops are slidingly movable between a retracted position and an extended position.

Also, the table includes a table leaf, having a molded plastic table top surface and first and second retainers disposed on an underside of the table leaf, wherein the first and second retainers are configured to fit over and mate with portions of the first and second cross members.

In certain embodiments, the table leaf is preferably movable from a storage position, in which the table leaf rests on the cross members beneath the sliding table tops, and a use position, in which the table leaf retainers are fitted over and mated with portions of the first and second cross members so that the table leaf top surface is aligned between and substantially coplanar with the first and second sliding table tops.

In certain embodiments, the first and second sliding table tops preferably each have an inner edge with a plurality of recesses and projections. The recesses and projections of the first sliding table top interlock with the recesses and projections of the second sliding table top when the first and second table tops are both in the retracted position. In addition, the table leaf preferably includes a first edge and a second edge, each edge having a plurality of recesses and projections. The recesses and projections of the table leaf first edge interlock with the recesses of the first sliding table top and the recesses and projections of the table leaf second edge interlock with the recesses of the second sliding table top, when the first and second table tops are both in the extended position.

In certain embodiments, the first and second cross members are preferably oriented generally parallel to one another and perpendicular to the first and second frame rails.

In certain embodiments, the first, second, third, and fourth table legs are each foldable and the table further comprises first, second, third, and fourth folding leg braces for securing the respective first, second, third, and fourth table legs to the table frame.

In another aspect, the present disclosure provides an extendable table system, which is movable between a retracted table configuration and an extended table configuration. According to one embodiment, the extendable table system includes a table frame, which in turn includes first and second longitudinal frame rails and third and fourth transverse frame rails secured to opposite ends of the first and second frame rails. The first and second frame rails are oriented generally parallel to one another, and the third and fourth frame rails are oriented generally parallel to one another and perpendicular to the first and second frame rails, so as to define a generally rectangular frame having four corners.

A first outer sliding track is secured adjacent an inner surface of the first longitudinal frame rail and a second outer sliding track is secured adjacent an inner surface of the second longitudinal frame rail.

The table system also includes first and second cross members each having a first end and a second end. The first ends of each cross member are secured to a lower portion of the first longitudinal frame rail, and the second ends of each cross member are secured to a lower portion of the second longitudinal frame rail.

In addition, the table system includes first, second, third, and fourth table legs, with each leg being secured to a different corner of the table frame.

First and second movable table tops are also included in the table, with each of the table tops including a molded plastic table top surface, a first inner sliding track secured adjacent a first outer edge of the table top, and a second inner sliding track secured adjacent a second outer edge of the table top. The inner sliding tracks of the first and second table tops are slidingly received within the outer sliding tracks.

Also, the table system includes a table leaf, having a molded plastic table top surface and first and second retainers disposed on an underside of the table leaf.

The table system is movable between a retracted table configuration and an extended table configuration. In the retracted table configuration, the first and second movable table tops are slid together along the first and second sliding tracks so that the table tops abut one another and the table leaf rests on the cross members beneath the sliding table tops. In the extended table configuration, the first and second movable table tops are slid apart along the first and second sliding tracks and the table leaf is disposed between the first and second movable table tops so that the table leaf retainers are fitted over and mated with portions of the first and second cross members and the table leaf top surface is substantially coplanar with the first and second sliding table tops.

In certain embodiments, the first and second sliding table tops preferably each have an inner edge with a plurality of recesses and projections. The recesses and projections of the first sliding table top interlock with the recesses and projections of the second sliding table top when the first and second table tops are both in the retracted position. In addition, the table leaf preferably includes a first edge and a second edge, each edge having a plurality of recesses and projections. The recesses and projections of the table leaf first edge interlock with the recesses of the first sliding table top and the recesses and projections of the table leaf second edge interlock with the recesses of the second sliding table top, when the first and second table tops are both in the extended position.

In certain embodiments, the first and second cross members are preferably oriented generally parallel to one another and perpendicular to the first and second frame rails.

In certain embodiments, the first, second, third, and fourth table legs are each foldable and the table further comprises first, second, third, and fourth folding leg braces for securing the respective first, second, third, and fourth table legs to the table frame.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
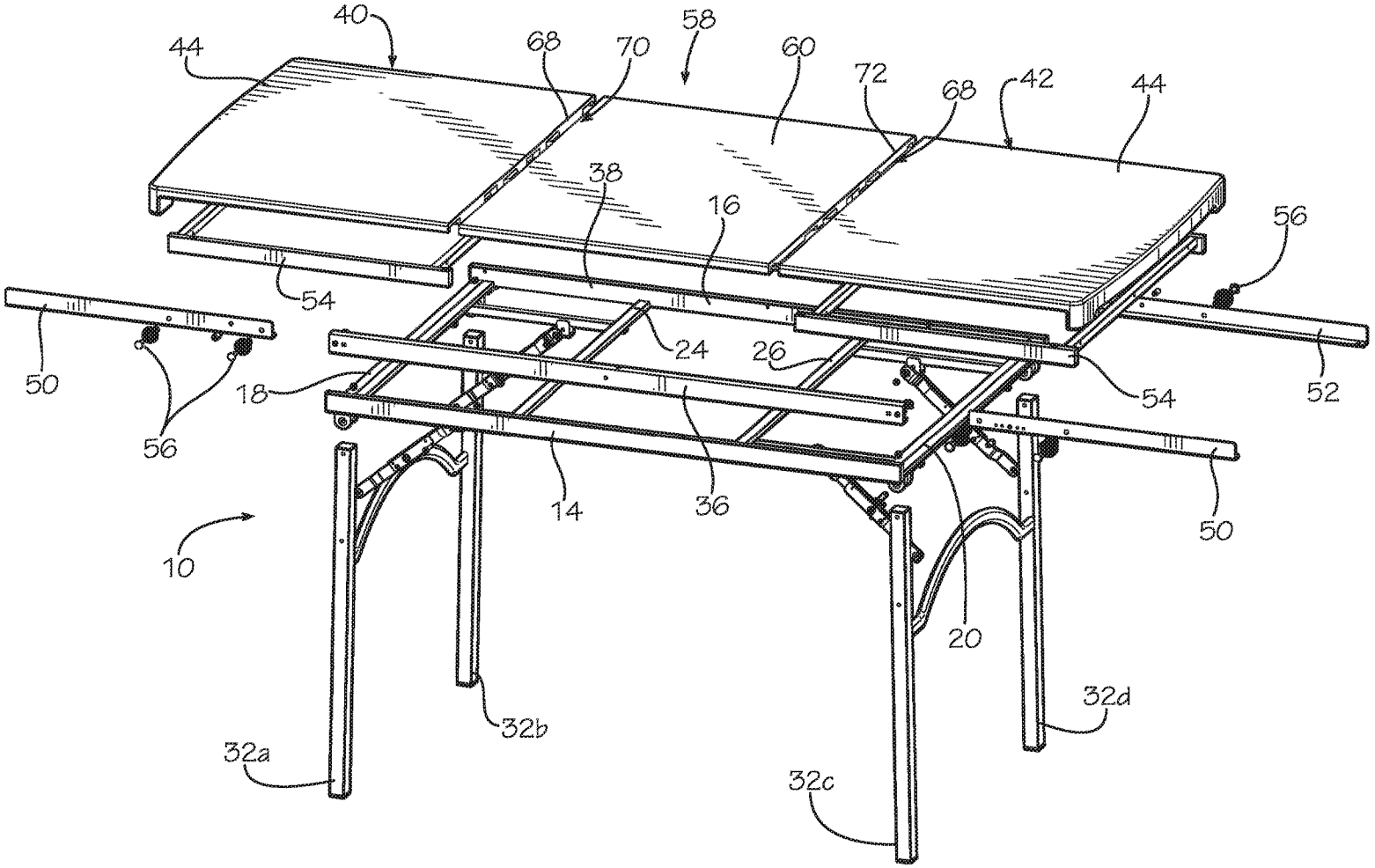
FIG. 1 is an assembly view of an extendable table according to one embodiment of the present disclosure, shown with a table leaf.
Figure 2:
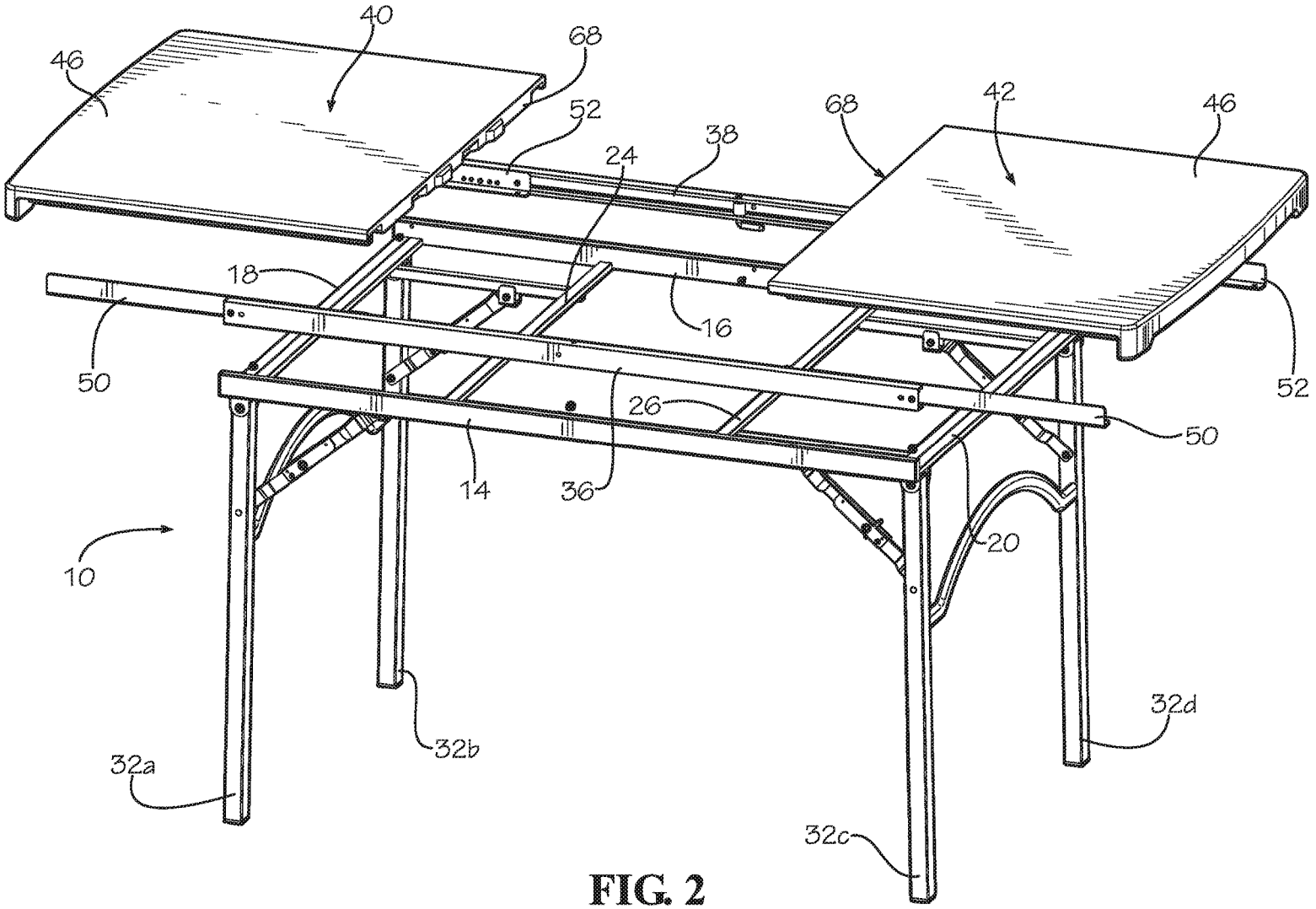
FIG. 2 is an assembly view of an extendable table according to one embodiment of the present disclosure, shown without a table leaf.

According to the present disclosure, an extendable table is provided. The table is movable between a retracted table configuration, having a shorter overall table top length, and an extended table configuration, having a longer overall table top length.

As shown in FIGS. 1-4, the extendable table 10 includes a table frame 12, made up of first, second, third, and fourth frame rails 14, 16, 18, 20. The first and second rails 14, 16 are longitudinal frame rails, extending along the length of the table 10, and are oriented generally parallel to one another. The third and fourth rails 18, 20 are transverse frame rails, extending across the width of the table 10. The third and fourth rails 18, 20 are oriented generally parallel to one another and perpendicular to the first and second frame rails 14, 16. The third and fourth rails 18, 20 are welded, bolted, or otherwise secured to opposite ends of the first and second frame rails 14, 16, so as to define a generally rectangular frame 12 having four corners 22*a*, 22*b*, 22*c*, 22*d*. The first, second, third, and fourth frame rails 14, 16, 18, 20 are each preferably formed from a stamped or extruded metal, such as steel.

In addition to the four frame rails, the table 10 also includes a first and a second cross member 24, 26, each extending below the four frame rails. Each of the first and second cross members 24, 26, includes a first end and a second end. The first ends 28*a*, 28*b* of the cross members 24, 26 are secured to a lower portion of the first longitudinal frame rail 14, and the second ends 30*a*, 30*b* of the cross members 24, 26 are secured to a lower portion of the second longitudinal frame rail 16. Like the four frame rails, the first and second cross members 24, 26 are each preferably formed from a stamped or extruded metal, such as steel.

In addition, the table 10 includes first, second, third, and fourth table legs 32*a*, 32*b*, 32*c*, 32*d*, with each leg being secured to a different corner 22*a*, 22*b*, 22*c*, 22*d* of the table frame 12. The table legs 32*a*, 32*b*, 32*c*, 32*d* are generally hollow and may have either a generally round or generally rectangular cross-section and may be formed from either metal or from a polymer. For instance, the legs 32*a*, 32*b*, 32*c*, 32*d* may be formed from tubular steel, or from extruded polymers.

Figure 3:
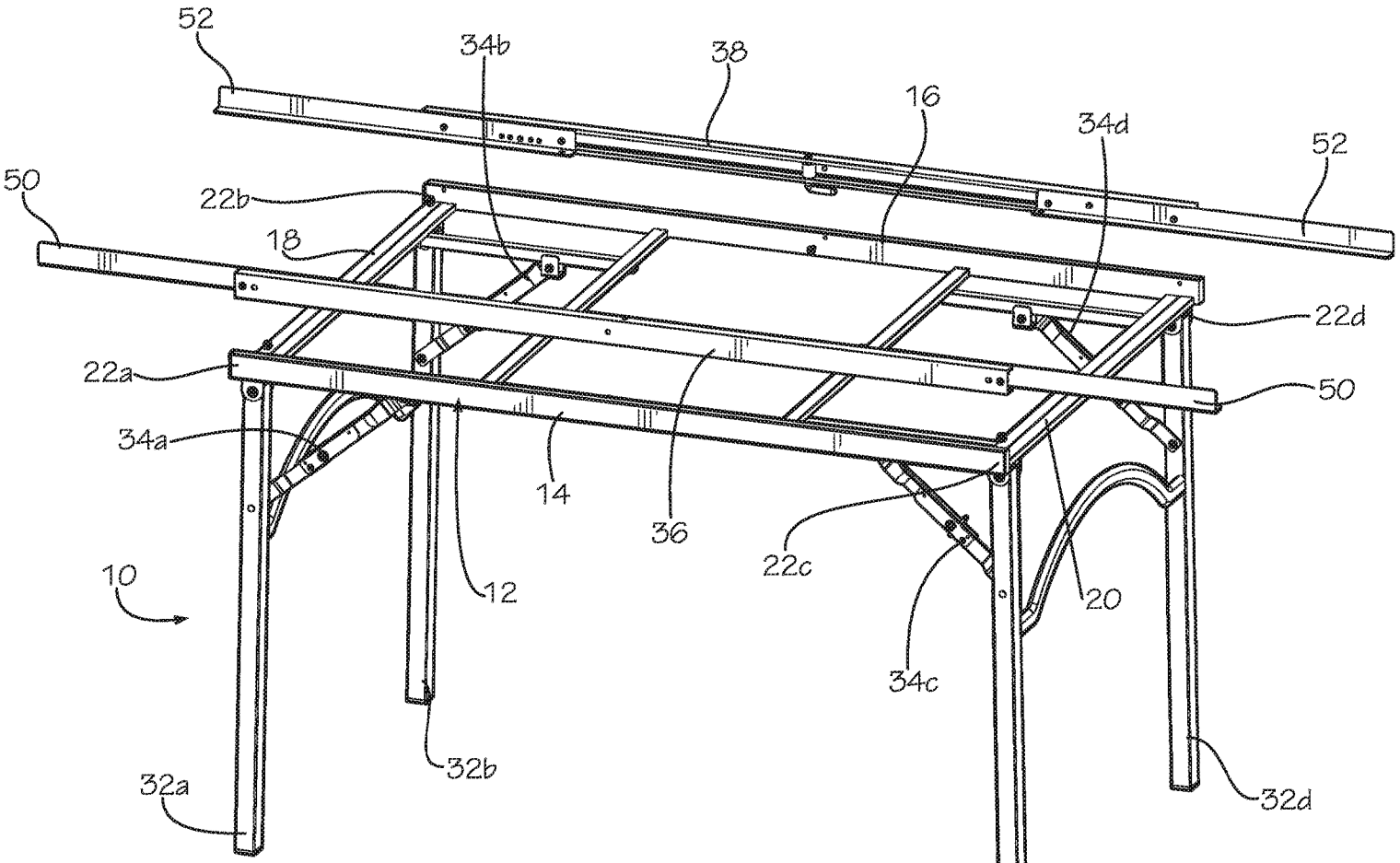
FIG. 3 is an assembly view of a frame for an extendable table according to one embodiment of the present disclosure, shown in an extended configuration.
Figure 4:
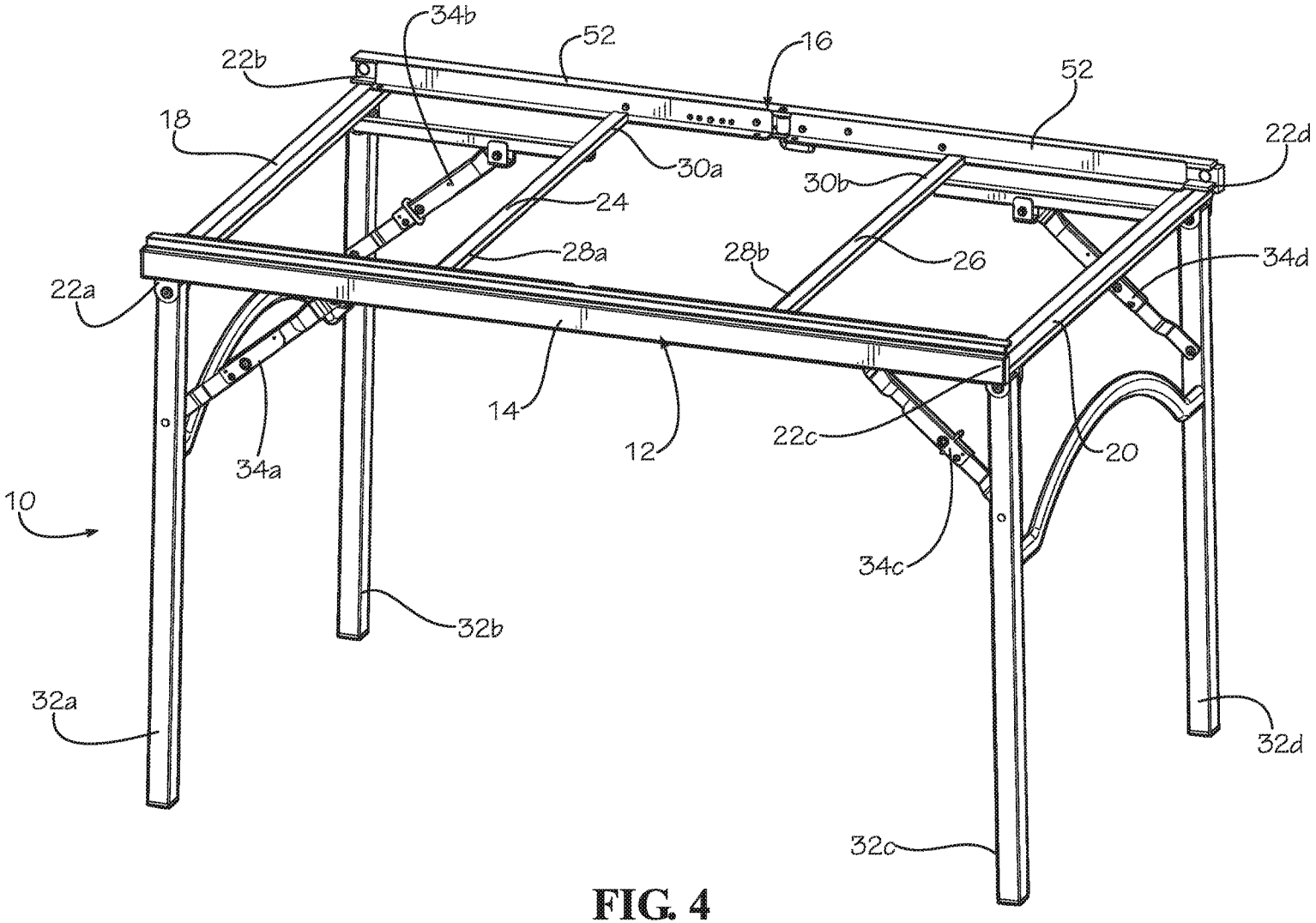
FIG. 4 is an assembly view of a frame for an extendable table according to one embodiment of the present disclosure, shown in a retracted configuration.

In some instances, the table legs 32*a*, 32*b*, 32*c*, 32*d* may be permanently attached to the table frame 12. In other embodiments, the table 10 may be of a "knock-down" design, wherein the table legs may be removable for ease of storage when the table is not in use. In another, more preferred embodiment, the table legs are foldable. More particularly, in a preferred embodiment, the first, second, third, and fourth table legs 32*a*, 32*b*, 32*c*, 32*d* are each foldable and the table includes first, second, third, and fourth folding leg braces 34*a*, 34*b*, 34*c*, 34*d* for securing the respective first, second, third, and fourth table legs 32*a*, 32*b*, 32*c*, 32*d* to the table frame 12, as illustrated in FIGS. 3 and 4. In some embodiments, the two legs at each respective end of the table may also be joined together by a crossbar.

The table also includes first and second outer sliding tracks 36, 38. A first outer sliding track 36 is secured adjacent an inner surface of the first longitudinal frame rail 14 and a second outer sliding track 38 is secured adjacent an inner surface of the second longitudinal frame rail 16. The first and second outer sliding tracks 36, 38 are generally formed from a metal such as steel and have a generally C-shaped cross-section. The outer sliding tracks 36, 38 may be secured to the longitudinal frame rails 14, 16 by screws, rivets, adhesive, or the like.

Above the frame 12, the table 10 also includes first and second movable table tops 40, 42. Both table tops 40, 42 may be slidably moved between a retracted position and an extended position.

Each of the first and second table tops 40, 42 includes a molded plastic table top surface 44*a*, 44*b*. In general, at least a portion of both the first and second table tops 40, 42 are preferably provided as blow-molded plastic members 46. These blow-molded plastic members 46 will generally have a substantially hollow interior in order to reduce the overall weight of the extendable table. In order to provide additional strength and rigidity to the hollow, molded plastic members 46, a pattern of ribs or other shapes may be formed into the molded lower surfaces 48 of each of the first and second table tops 40, 42.

Each of the first and second movable table tops 40, 42 also includes a first inner sliding track 50 secured adjacent a first outer edge of the table top and a second inner sliding track 52 secured adjacent a second outer edge of the table top. The inner sliding tracks 50, 52 of the first and second table tops 40, 42 are slidingly received within the outer sliding tracks 36, 38 so that the first and second table tops 40, 42 are slidingly movable between a retracted position and an extended position.

Like the outer sliding tracks 36, 38, the first and second inner sliding tracks 50, 52 are generally formed from a metal such as steel and may be secured to the longitudinal frame rails by screws, rivets, adhesive, or the like. The first and second inner sliding tracks 50, 52 preferably have a generally L-shaped cross-section and are sized to be received within the outer sliding tracks 36, 38. In some embodiments of the table, the respective first and second inner sliding tracks 50, 52 of each movable table top 40, 42 may each be secured to one or more reinforcement bars 54, which extend underneath and provide extra support for, the movable table tops 40, 42. One or more rollers 56 may also be rotatably secured to each of the inner sliding tracks, to facilitate movement of the inner sliding tracks 50, 52 within the outer sliding tracks 36, 38.

Finally, the table includes a removable table leaf 58. The table leaf 58 has a molded plastic table top surface 60 and first and second retainers 62, 64 disposed on an underside 66 of the table leaf 58. These retainers 62, 64 are configured to fit over and mate with portions of the first and second cross members 24, 26. Like the first and second table tops 40, 42, at least a portion of the table leaf 58 is preferably provided as a blow-molded plastic member. The first and second retainers 62, 64 then may be molded into the shape of the underside 66 of the table leaf 58. Alternatively, the retainers 62, 64 may be separately formed and then secured to the underside of the table leaf 58.

Figure 5:
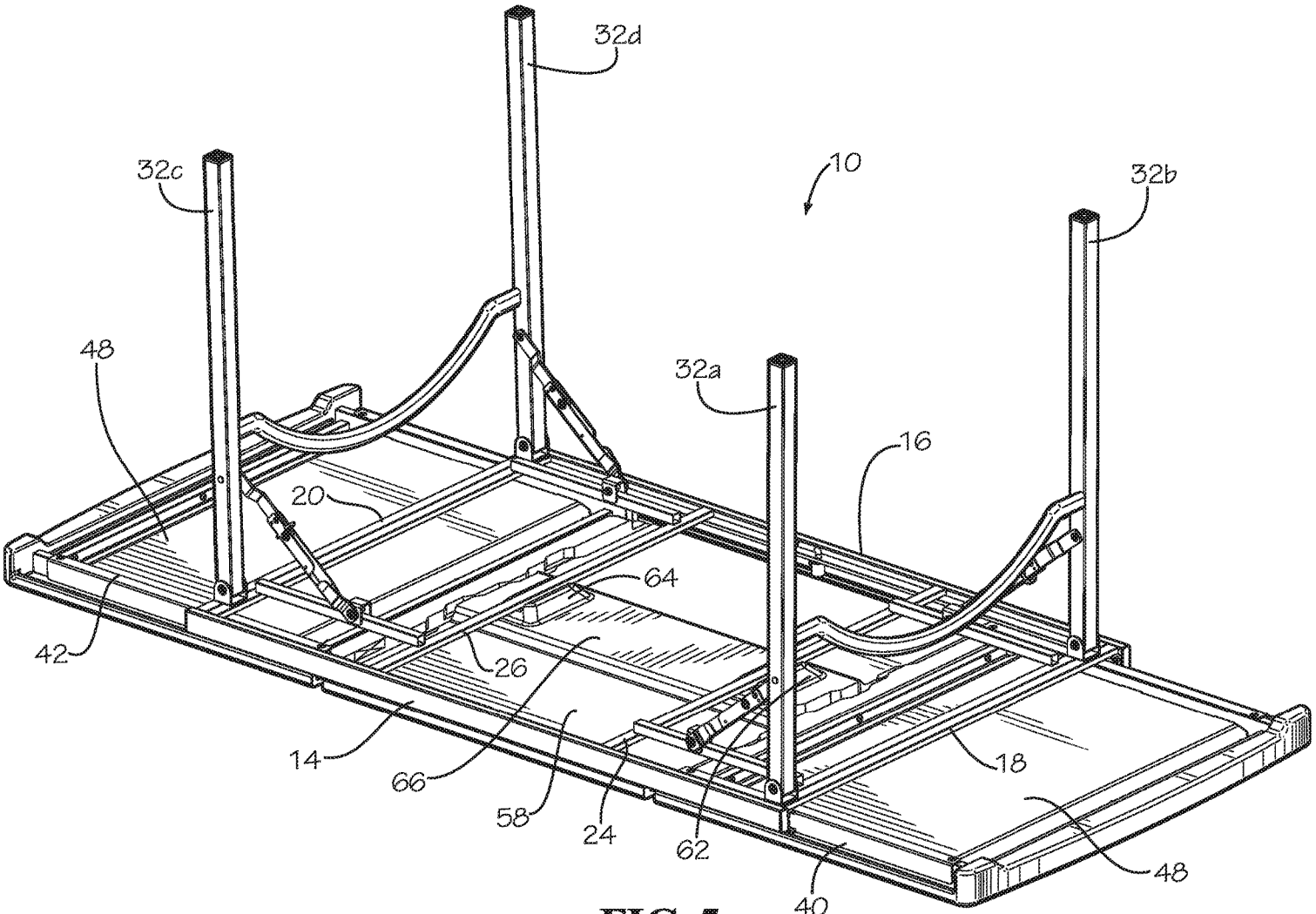
FIG. 5 is a bottom perspective view of an extendable table according to one embodiment of the present disclosure, shown in an extended configuration.
Figure 6:
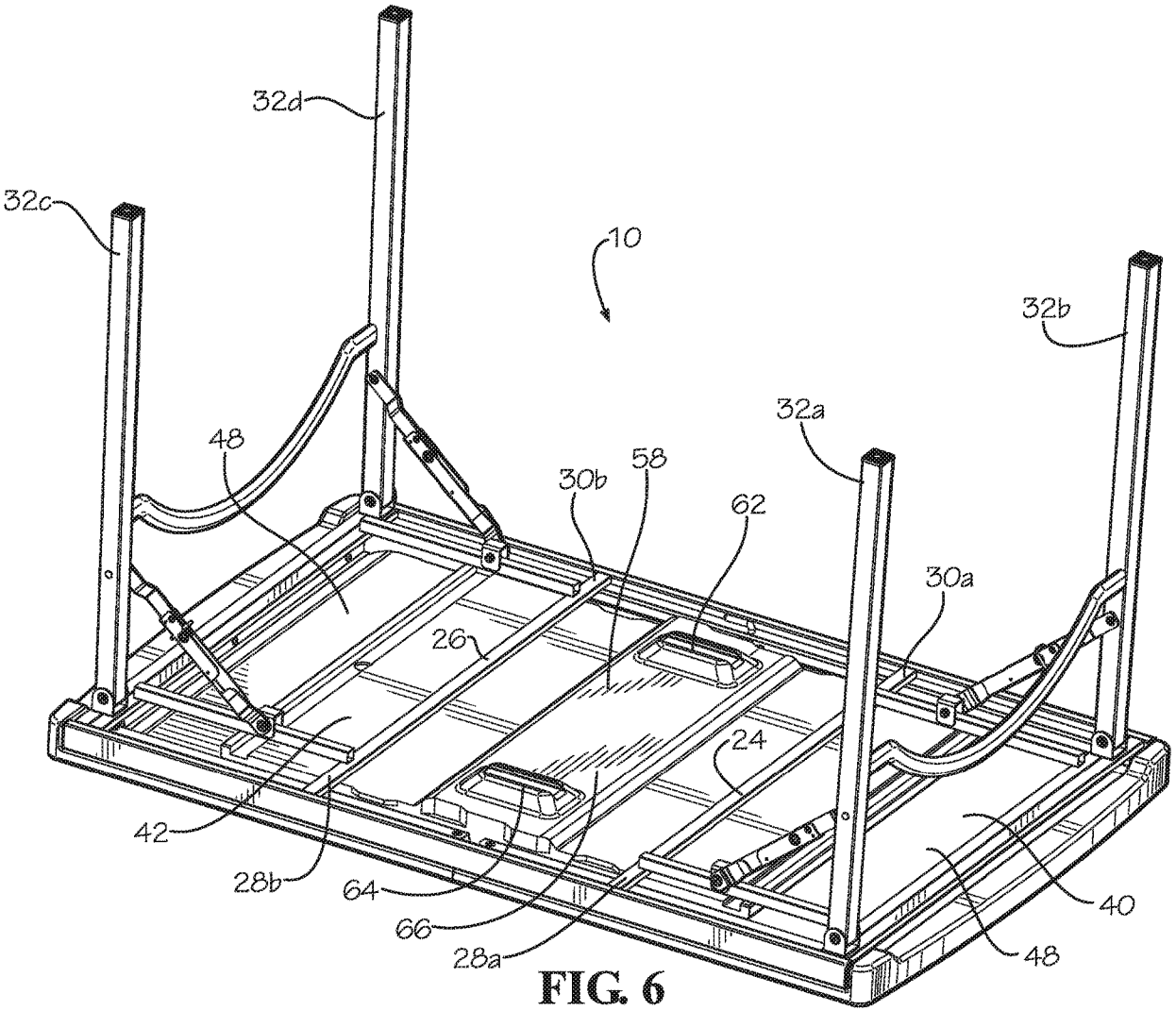
FIG. 6 is a bottom perspective view of an extendable table according to one embodiment of the present disclosure, shown in a retracted configuration.

In use, the table is movable between a retracted table configuration, in which the table leaf 58 is retained in a storage position as shown in FIG. 6, and an extended table configuration, in which the table leaf 58 is retained in a use position as shown in FIG. 5.

In the retracted table configuration, the first and second movable table tops 40, 42 are slid together along the first and second sliding tracks so that the table tops 40, 42 abut one another and the table leaf 58 is stored below the table tops 40, 42, resting on the cross members 24, 26 beneath the sliding table tops. In this retracted table configuration, table leaf 58 is oriented so that the retainers 62, 64 are offset from—and thus not mated to—the first and second cross members 24, 26. Moreover, in the retracted table configuration, the overall length of the table 10 is equivalent to the combined lengths of the first and second table tops 40, 42, which is generally from about 48 to about 96 inches.

In the extended table configuration, the first and second movable table tops 40, 42 are slid apart along the first and second sliding tracks and the table leaf 58 is disposed between the first and second movable table tops 40, 42 so that the table leaf retainers 62, 64 are fitted over and mated with portions of the first and second cross members 24, 26 and the table leaf top surface 60 is substantially coplanar with the first and second sliding table tops 40, 42. In this extended table configuration, the overall length of the table 10 is equivalent to the combined lengths of the first and second table tops 40, 42, plus the table leaf 58. In general, the overall table length in this extended configuration is generally from about 60 to about 144 inches.

If desired, the first and second sliding table tops 40, 42 may each have an inner edge 68, with each inner edge 68 having a plurality of recesses and projections. The recesses and projections along the inner edge 68 of the first sliding table top 40 interlock with the recesses and projections along the inner edge 68 of the second sliding table top 42 when the first and second table tops 40, 42 are both in the retracted position. In addition, the table leaf 58 may include a first edge 70 and a second edge 70, with each edge 70, 72 having a plurality of recesses and projections. The recesses and projections of the table leaf first edge 70 interlock with the recesses and projections along the inner edge 68 of the first sliding table top 40 and the recesses and projections of the table leaf second edge interlock with the recesses and projections along the inner edge 68 of the second sliding table top 42, when the first and second table tops 40, 42 are both in the extended position.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An extendable table, comprising:

a table frame, including first and second longitudinal frame rails and third and fourth transverse frame rails secured to opposite ends of the first and second frame rails, the first and second frame rails being oriented generally parallel to one another and the third and fourth frame rails being oriented generally parallel to one another and perpendicular to the first and second frame rails, so as to define a generally rectangular frame having four corners;

a first outer sliding track secured adjacent an inner surface of the first longitudinal frame rail and a second outer sliding track secured adjacent an inner surface of the second longitudinal frame rail;

first and second cross members each having a first end and a second end, the first ends of each cross member being secured to a lower portion of the first longitudinal frame rail and the second ends of each cross member being secured to a lower portion of the second longitudinal frame rail;

first, second, third, and fourth table legs, each leg being secured to a different corner of the table frame;

first and second movable table tops, each of the table tops including a molded plastic table top surface, a first inner sliding track secured adjacent a first outer edge of the table top, and a second inner sliding track secured adjacent a second outer edge of the table top, wherein the inner sliding tracks of the first and second table tops are slidingly received within the outer sliding tracks so that the first and second table tops are slidingly movable between a retracted position and an extended position; and a table leaf including a molded plastic table top surface and first and second retainers disposed on an underside of the table leaf, wherein the first and second retainers are configured to fit over and mate with portions of the first and second cross members.

2. The extendable table of claim 1, wherein the table leaf is movable from a storage position, in which the table leaf rests on the cross members beneath the sliding table tops, and a use position, in which the table leaf retainers are fitted over and mated with portions of the first and second cross members so that the table leaf top surface is aligned between and substantially coplanar with the first and second sliding table tops.

3. The extendable table of claim 1, wherein the first and second sliding table tops each have an inner edge with a plurality of recesses and projections, and wherein the recesses and projections of the first sliding table top interlock with the recesses and projections of the second sliding table top when the first and second table tops are both in the retracted position.

4. The extendable table of claim 3, wherein the table leaf includes a first edge and a second edge, each edge having a plurality of recesses and projections, and wherein the recesses and projections of the table leaf first edge interlock with the recesses of the first sliding table top and the recesses and projections of the table leaf second edge interlock with the recesses of the second sliding table top, when the first and second table tops are both in the extended position.

5. The extendable table of claim 1, wherein the first and second cross members are oriented generally parallel to one another and perpendicular to the first and second frame rails.

6. The extendable table of claim 1, wherein the first, second, third, and fourth table legs are each foldable and the table further comprises first, second, third, and fourth folding leg braces for securing the respective first, second, third, and fourth table legs to the table frame.

7. An extendable table system, movable between a retracted table configuration and an extended table configuration, the table system comprising:

a table frame, including first and second longitudinal frame rails and third and fourth transverse frame rails secured to opposite ends of the first and second frame rails, the first and second frame rails being oriented generally parallel to one another and the third and fourth frame rails being oriented generally parallel to one another and perpendicular to the first and second frame rails, so as to define a generally rectangular frame having four corners;

a first outer sliding track secured adjacent an inner surface of the first longitudinal frame rail and a second outer sliding track secured adjacent an inner surface of the second longitudinal frame rail;

first and second cross members each having a first end and a second end, the first ends of each cross member being secured to a lower portion of the first longitudinal frame rail and the second ends of each cross member being secured to a lower portion of the second longitudinal frame rail;

first, second, third, and fourth table legs, each leg being secured to a different corner of the table frame;

first and second movable table tops, each of the table tops including a molded plastic table top surface and a first inner sliding track secured adjacent a first outer edge of the table top and a second inner sliding track secured adjacent a second outer edge of the table top, wherein the inner sliding tracks of the first and second table tops are slidingly received within the outer sliding tracks; and a table leaf including a molded plastic table top surface and first and second retainers disposed on an underside of the table leaf, wherein the table system is movable between a retracted table configuration and an extended table configuration, wherein, in the retracted table configuration, the first and second movable table tops are slid together along the sliding tracks so that the table tops abut one another and the table leaf rests on the cross members beneath the sliding table tops, and wherein, in the extended table configuration, the first and second movable table tops are slid apart along the sliding tracks and the table leaf is disposed between the first and second movable table tops so that the table leaf retainers are fitted over and mated with portions of the first and second cross members and the table leaf top surface is substantially coplanar with the first and second sliding table tops.

8. The extendable table system of claim 7, wherein the first and second sliding table tops each have an inner edge with a plurality of recesses and projections, and wherein the recesses and projections of the first sliding table top interlock with the recesses and projections of the second sliding table top when the first and second table tops are both in the retracted position.

9. The extendable table system of claim 8, wherein the table leaf includes a first edge and a second edge, each edge having a plurality of recesses and projections, and wherein the recesses and projections of the table leaf first edge interlock with the recesses of the first sliding table top and the recesses and projections of the table leaf second edge interlock with the recesses of the second sliding table top, when the first and second table tops are both in the extended position.

10. The extendable table system of claim 7, wherein the first and second cross members are oriented generally parallel to one another and perpendicular to the first and second frame rails.

11. The extendable table system of claim 7, wherein the first, second, third, and fourth table legs are each foldable and the table further comprises first, second, third, and fourth folding leg braces for securing the respective first, second, third, and fourth table legs to the table frame.

* * * * *